US007954359B1

(12) United States Patent
Paderewski et al.

(10) Patent No.: US 7,954,359 B1
(45) Date of Patent: Jun. 7, 2011

(54) METHOD AND APPARATUS FOR IMPACT DETECTION AND PRIORITIZATION OF IMPACT INFORMATION TRANSMITTED TO A RECEIVING STATION

(75) Inventors: Gary Paderewski, Colorado Springs, CO (US); John LeSage, Colorado Springs, CO (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 1755 days.

(21) Appl. No.: 11/154,691

(22) Filed: Jun. 17, 2005

(51) Int. Cl.
*G01P 15/00* (2006.01)

(52) U.S. Cl. ..... 73/12.09; 73/12.01

(58) Field of Classification Search ..... 37/11.01–12.09; 324/240, 262; 73/11.01–12.09
See application file for complete search history.

(56) References Cited

U.S. PATENT DOCUMENTS 4,399,430 A 8/1983 Kitchen
4,450,434 A 5/1984 Nielsen et al.
4,581,527 A 4/1986 Crane et al.
5,013,908 A 5/1991 Chang
7,506,543 B2 * 3/2009 Chiodo et al. ..... 73/172
2004/0201677 A1 10/2004 Bronson
2005/0085257 A1 4/2005 Laird et al.
2008/0283599 A1 * 11/2008 Rasband et al. ..... 235/439
* cited by examiner

*Primary Examiner* — Lisa M Caputo
*Assistant Examiner* — Jonathan Dunlap
(74) *Attorney, Agent, or Firm* — Edell, Shapiro & Finnan, LLC

(57) ABSTRACT

An impact detection system according to the present invention includes an impact sensor, damage sensors and an electronics package. The impact sensor includes a fiber optic grid preferably attached to a target object to detect impact locations on the target. The damage sensors measure damage sustained by the object, while the electronics package monitors the fiber optic grid, records the impact location and sends information pertaining to the impact location and target damage through a telemetry link with limited bandwidth to a receiving station. In order to ensure transmission of desired information, the electronics package allocates telemetry bandwidth to sensor information most relevant to impact location and target damage to enable transmission in the limited time interval available prior to target destruction or impact detection system disablement. This is accomplished by dynamically allocating reporting priority to different sensors during an impact.

17 Claims, 5 Drawing Sheets

METHOD AND APPARATUS FOR IMPACT DETECTION AND PRIORITIZATION OF IMPACT INFORMATION TRANSMITTED TO A RECEIVING STATION

STATEMENT REGARDING FEDERALLY SPONSORED RESEARCH OR DEVELOPMENT

The U.S. Government may have a paid-up license in this invention and the right in limited circumstances to require the patent owner to license others on reasonable terms as provided by the terms of the contract.

BACKGROUND OF THE INVENTION

1. Technical Field

The present invention pertains to impact detection on a target object. In particular, the present invention pertains to detection of impacts and subsequent effects on a target object and prioritizing transmission of information from various sensors to a receiving station.

2. Discussion of Related Art

Various applications may employ detection of impacts on an object to assess damage, structural integrity or other properties of the object affected by an impact. The impact detections may further provide information relating to properties of an article impacting the object. For example, ballistic missile defense flight target testing employs impact detection on a target to assess the nature of a missile impact (e.g., missile accuracy, lethality of an impact, damage to target object, etc.). A related art system for impact detection includes a sensor package that employs a fiber optic grid attached to a target object (e.g., a ballistic missile target, etc.) and an electronics package that monitors the fiber optic grid, records the impact location and sends data through a telemetry stream or link before total physical destruction of the target. An exemplary type of fiber optic grid system for detecting impact locations is disclosed in U.S. Pat. No. 5,013,908 (Chang), the disclosure of which is incorporated herein by reference in its entirety.

The basic function of the related art system is to sense and record the initial impact location on a missile target based on an engagement from an intercept vehicle or missile. The system performs these tasks within approximately ten microseconds (e.g., prior to destruction of the target). When the intercept vehicle impacts the target, optical fibers within the fiber optic grid attached to the target are severed and the sensor package determines the impacted fibers sustaining damage. The system reports the time sequence of optical fiber severs to a ground telemetry receiving station via the remote telemetry link. Since the optical fibers are arranged on the target in a predetermined pattern, the system is able to determine the impact locations on the target and provide data to construct a damage versus time profile. Further, the related art system has been modified to include additional sensors (i.e., pressure transducers, mechanical damage sensors, etc.) and improvements in weight, size and reliability.

The related art system suffers from several disadvantages. In particular, the impact location and damage sustained by a target object are information desired from a target impact. However, the related art system (without additional sensors) provides information pertaining only to the impact location (e.g., by measuring the optical fiber sever sequence and transmitting that data to a remote receiving station), thereby lacking provisions to collect damage information of the target object.

Although the related art system may include damage sensors as described above, the sensor information is reported in the order the information is received. Thus, internal damage sensor information competes with fiber optic grid information for telemetry bandwidth during an impact. This enables valuable information pertaining to the target impact to be lost due to lack of transmission of that information within the limited time interval available prior to target destruction.

OBJECTS AND SUMMARY OF THE INVENTION

Accordingly, it is an object of the present invention to prioritize transmission of sensor information from an impact detection system to a receiving station to efficiently utilize limited telemetry bandwidth.

It is another object of the present invention to allocate telemetry bandwidth within an impact detection system in accordance with the priority of sensor information to enable transmission of the sensor information to a receiving station.

Yet another object of the present invention is to detect impact locations on a target object via a fiber optic grid.

The aforesaid objects may be achieved individually and/or in combination, and it is not intended that the present invention be construed as requiring two or more of the objects to be combined unless expressly required by the claims attached hereto.

According to the present invention, an impact detection system includes an impact sensor, damage sensors and an electronics package. The impact sensor includes a fiber optic grid preferably attached to a target object (e.g., a ballistic missile target, etc.) to detect impact locations on the target. The damage sensors measure damage sustained by the object, while the electronics package monitors the fiber optic grid, records the impact location and sends information pertaining to the impact location and target damage through a telemetry link or stream to a receiving station. The telemetry stream provides a limited telemetry bandwidth (e.g., transmission of information to a remote receiving station occurs at a limited rate).

The present invention transmits sensor information in the limited time interval available between target impact and subsequent destruction of the target and/or disablement of the impact detection system. However, since the electronics package collects sensor information at a higher rate than the transmission rate of the telemetry link, the telemetry link becomes a bottleneck for transmission of the sensor information to the receiving station in particular applications. The bottleneck may prevent transmission of desired sensor information prior to target destruction or impact detection system disablement, thereby causing loss of that information. In order to ensure transmission of desired sensor information, the electronics package of the present invention allocates telemetry bandwidth to sensor information most relevant to impact location and target damage to enable transmission of that information in the limited time interval available prior to target destruction or impact detection system disablement. This is accomplished by dynamically allocating reporting priority to different sensors during an impact, where the most important or desired information receives priority for the limited telemetry bandwidth and reporting time interval.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

The present invention pertains to detection of impacts and subsequent effects on a target object and prioritizing transmission of information from various sensors to a receiving station. By way of example only, the present invention may be applied to ballistic missile defense flight target testing to detect and assess the nature of a missile impact (e.g., missile accuracy, lethality of an impact, damage to a target object, etc.).

Figure 1:
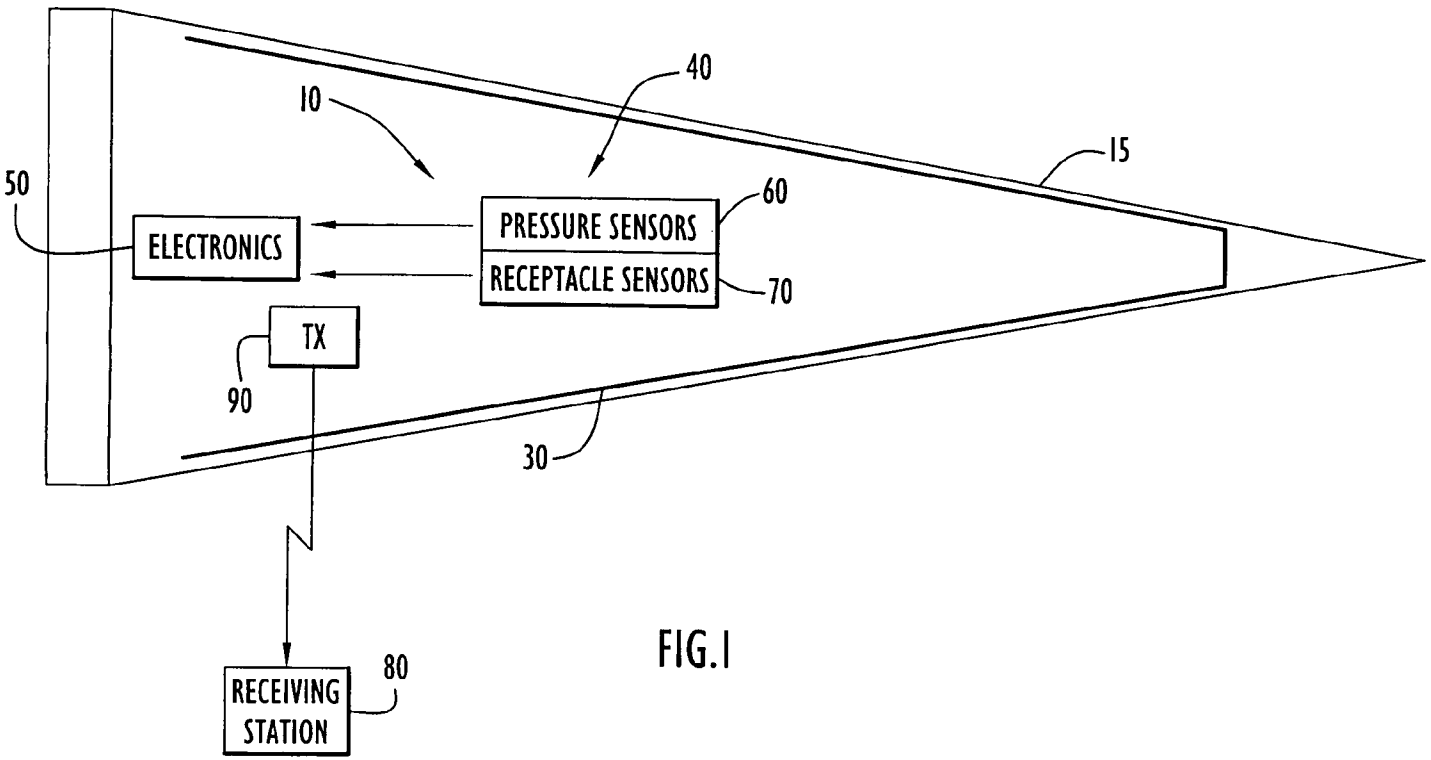
FIG. 1 is a block diagram of an impact detection system according to the present invention employed within an exemplary target object.

An impact detection system according to the present invention is illustrated in FIG. 1. Specifically, an impact detection system 10 is disposed within an exemplary target object 15 (e.g., missile target, target vehicle, etc.). The target object typically includes a housing defining an interior space for the impact detection system and other articles. The impact detection system includes impact sensor 30, sensor unit 40, an electronics package 50 and a transmitter 90. The impact sensor is arranged in the form of a grid that is typically disposed proximate the interior surface of target object housing walls to detect the location of an impact on the target object as described below.

Figure 2:
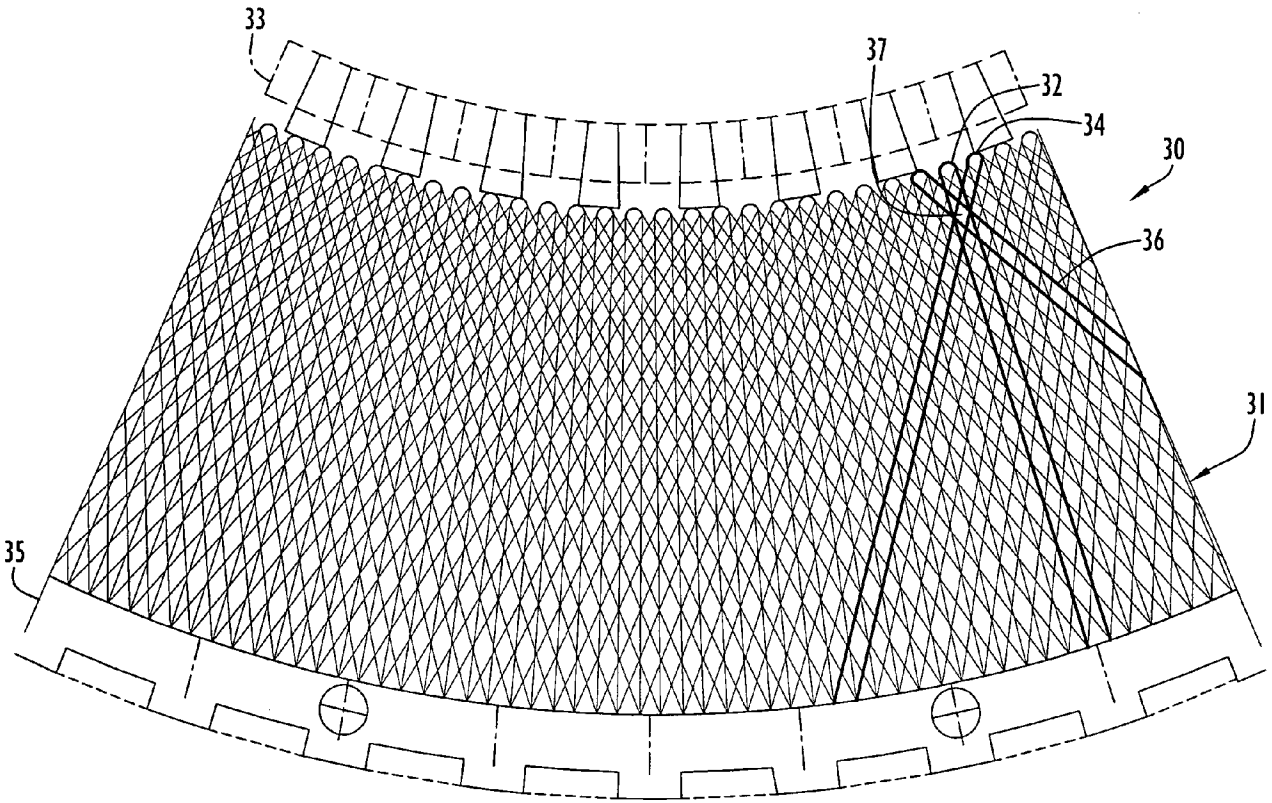
FIG. 2 is a view in elevation of an exemplary impact sensor in the form of an optical fiber grid employed by the impact detection system of the present invention to detect impact locations on a target object.

Referring to FIG. 2, impact sensor 30 is arranged in the form of a grid 31 of optical fibers 32, 34, 36. The optical fibers are each coupled to and extend between a source terminal or connector 33 and a detector terminal or connector 35. Optical fibers 32 are arranged substantially vertically or in parallel relation with a grid axis extending from source connector 33 to detector connector 35 (e.g., as viewed in FIG. 2). Optical fibers 34 are arranged to extend at an angle relative to the grid axis (e.g., toward the right as viewed in FIG. 2) and intersect a series of optical fibers 32. Optical fibers 36 are arranged to extend at an angle (e.g., toward the left as viewed in FIG. 2) opposing angled optical fibers 34 and similarly intersect a series of optical fibers 32, 34. Thus, grid 31 is in the form of a mesh of intersecting optical fibers 32, 34, 36. The intersections of optical fibers 32, 34, 36 define a series of areas 37 within the grid that may be identified as described below to indicate an impact location. The optical fibers may be implemented by any conventional or other medium (e.g., fiber optic cables, etc.) capable of carrying an optical signal.

Each optical fiber 32, 34, 36 within grid 31 receives an optical or laser signal from a laser source 92 (FIG. 3) coupled to source terminal 33, while detector terminal 35 is coupled to corresponding detectors 94 (FIG. 3) to detect the optical signal carried by each fiber 32, 34, 36. In operation, the grid optical fibers receive and carry the optical signal from source terminal 33. This signal is detected by detectors 94. However, when an impact occurs on the target object, fibers within grid 31 are severed and no longer carry the optical signal. The detectors detect the absence of optical signals to identify the fibers severed by the impact. A timestamp is provided with each detection to identify the location of the impact within the grid as described below. In particular, areas 37 within the grid include dimensions less than those of an intercept object impacting the target. Accordingly, an impact severs at least one of each type of optical fiber 32, 34, 36. The detectors detect the absence of the optical signals on the optical fibers and the particular group of fibers 32, 34, 36 severed by the impact is determined based on the timestamps (e.g., each fiber of the group is severed within a certain time interval of each other for a corresponding impact). An area 37 defined by the intersection of the severed group of fibers indicates the impact location. This determination is typically performed by receiving station 80 receiving detection information from system 10 as described below.

Referring back to FIG. 1, sensor unit 40 may include various types of sensors to measure the effects of an impact. For example, sensor unit 40 may include pressure sensors 60 and receptacle sensors 70. The pressure sensors are typically disposed within one or more receptacles containing fluid within the target object and may measure the pressure within those receptacles indicating an amount of receptacle damage. The pressure sensors may be implemented by any conventional or other pressure transducers or sensors. Receptacle sensors 70 are each typically disposed about the periphery of a corresponding fluid receptacle to detect a rupture within that receptacle. These sensors are preferably implemented by wires carrying a signal, where detection of the absence of the signal indicates a severed wire and a rupture of the corresponding receptacle. The receptacles and corresponding sensors may be disposed at any suitable locations within the target object and are typically utilized for damage assessment by simulating corresponding receptacles within actual targets. Sensors 60, 70 basically measure the effects or damage to the target object or target object contents subsequent an impact as described below. However, sensor unit 40 may include any types of sensors disposed at any suitable locations to measure any desired impact effects or other conditions of the target object.

Electronics package 50 is coupled to impact sensor 30 and sensor unit 40 and processes the sensor information for transmission to receiving station 80 via transmitter 90. Sensors 30, 40 are classified into priority groups (e.g., Groups A, B and C) to allocate telemetry bandwidth for transmission of sensor information to the receiving station as described below. The transmitter may be implemented by any conventional or other transmitter or transmitting device and transmits sensor information from electronics package 50 to the receiving station for processing. The receiving station processes the sensor information to determine impact location and subsequent effects or damage. The receiving station may be implemented by any conventional or other receiving unit and preferably includes a conventional or other processor and communications or other equipment (e.g., receiver, application specific equipment, etc.) to receive and process the sensor information.

Figure 3:
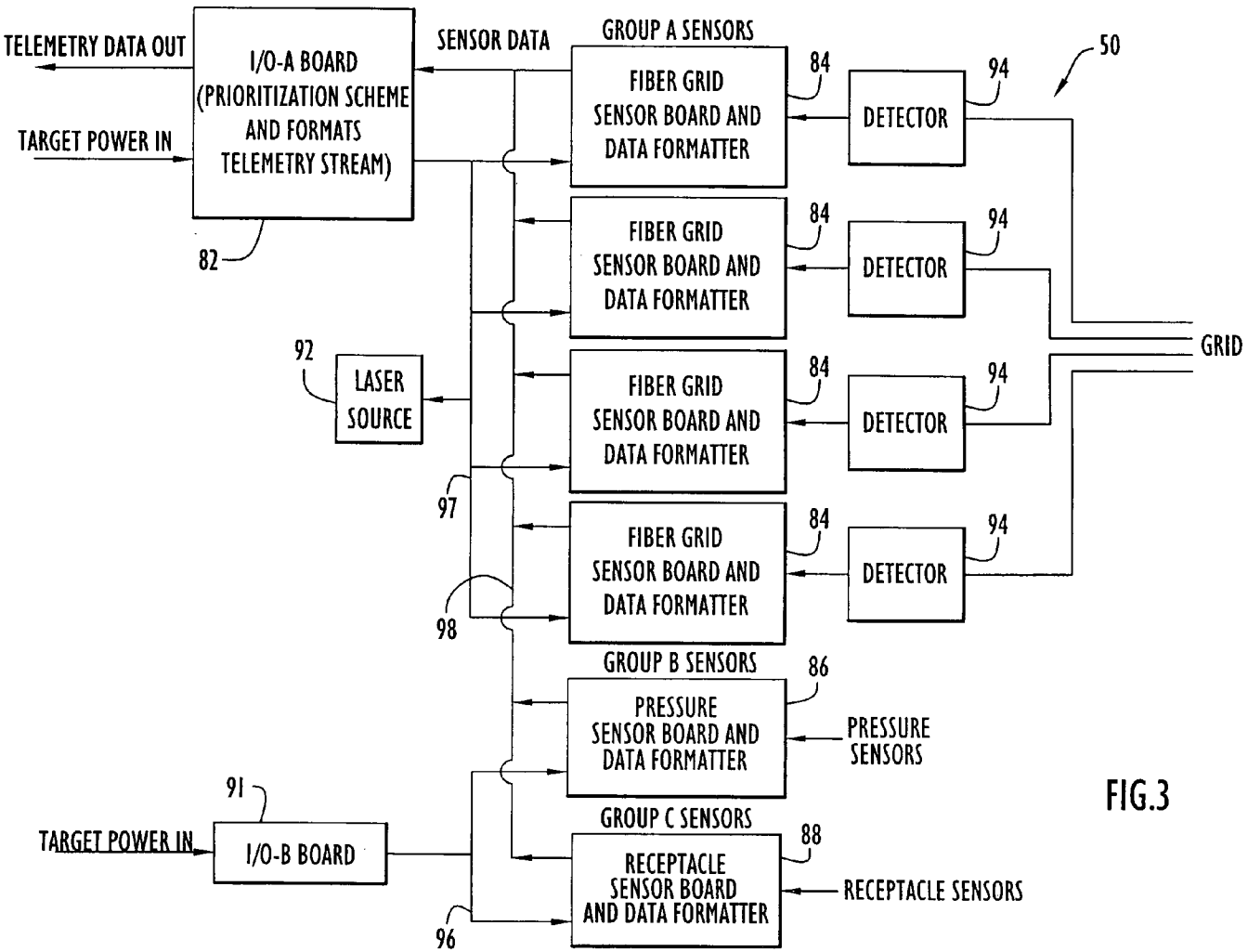
FIG. 3 is a block diagram of the electronics package of the impact detection system of the present invention.

Electronics package 50 employed by the present invention is illustrated in FIG. 3. Specifically, electronics package 50 includes a processor circuit or module 82, one or more grid circuits or modules 84, pressure sensor damage circuit or module 86, receptacle sensor damage circuit or module 88, a power circuit or module 91, laser source 92 and one or more detector circuits or units 94. The electronics package components (e.g., power circuit, grid circuits, damage circuits, processor circuit, detector units, etc.) are preferably implemented by conventional hardware modules or circuitry (e.g., Application Specific Integrated Circuit (ASIC), logic, programmable gate arrays, etc.), but may be implemented by any hardware and/or software modules performing the functions described below. By way of example only: the electronics package includes four grid circuits 84 each including sixty-four channels to accommodate and receive information from a maximum of sixty-four fibers of grid 31; pressure sensor damage circuit 86 includes eight channels to accommodate and receive information from a maximum of eight of the pressure sensors described above; and receptacle sensor damage circuit 88 includes thirty-two channels to accommodate and receive information from a maximum of thirty-two of the receptacle sensors described above. However, the electronics package may include any quantity of circuits or modules including any quantity of channels and accommodating any quantity of any types of sensors.

Power circuit 91 receives power from the target object and distributes appropriate power signals to pressure sensor circuit 86 and receptacle sensor circuit 88 via a power bus 96. Pressure sensor circuit 86 receives signals from pressure sensors 60 (FIG. 1) and is coupled to a data bus 98. The data and power busses may be implemented by any conventional or other devices transporting data and/or power signals (e.g., busses, etc.). The pressure sensor circuit conditions the pressure sensor signals and produces digital signals for processing by processor circuit 82. Pressure sensor circuit 86 further provides a timestamp (e.g., GPS time, internal clock, etc.) for each measurement received from the pressure sensors to enable correlation of the measurements with an impact. Similarly, receptacle sensor circuit 88 receives signals from receptacle sensors 70 (FIG. 1) and is coupled to data bus 98. Receptacle sensor circuit 88 conditions the receptacle sensor signals and produces digital signals for processing by processor circuit 82. Receptacle sensor circuit 88 further provides a timestamp (e.g., GPS time, internal clock, etc.) for each measurement received from the receptacle sensors to enable correlation of the measurements with an impact.

Laser source 92 is coupled to source terminal 33 (FIG. 2) of impact sensor 30 and provides optical signals to grid 31 as described above. The laser source may be implemented by any conventional or other optical source to provide an optical signal (e.g., laser, light source, LEDs, etc.). Detector units 94 are each coupled to detector terminal 35 (FIG. 2) of the impact sensor to detect the presence or absence of the optical signal within each grid optical fiber, thereby indicating the occurrence of an impact. The detector units may be implemented by any conventional or other optical detectors (e.g., photo-detectors, etc.) and may each accommodate any suitable quantity of fibers. The detector units are each further coupled to a corresponding grid circuit 84. Each grid circuit receives signals from a corresponding detector unit 94 and is coupled to data bus 98. The grid circuits each condition signals from the detector units and produce digital signals for processing by processor circuit 82. The gird circuits further provide a timestamp (e.g., GPS time, internal clock, etc.) for each detection or measurement received by the detection units to enable correlation of severed fibers with an impact and determination of an impact location as described above.

Processor circuit 82 receives power from the target object and provides power signals to the grid circuits and laser source 92 via a power bus 97. The power bus may be implemented by any conventional or other devices transporting power signals (e.g., busses, etc.). The processor circuit is further coupled to data bus 98 and receives information from grid circuits 84 and damage circuits 86, 88. The grid and damage circuits basically utilize a flag on data bus 98 to notify processor circuit 82 that sensor information is available. Since information may be available simultaneously from each of the grid and damage circuits, the processor circuit prioritizes the grid and sensor information and allocates the telemetry bandwidth in accordance with the prioritization to transmit desired information to the receiving station in the available time interval between impact and target destruction or impact detection system disablement as described below.

The processor circuit retrieves sensor information from the grid and damage circuits via data bus 98 upon availability of that information (e.g., in response to corresponding flags on data bus 98). The processor circuit includes a series of queues, preferably First-In-First-Out (FIFO) type queues, each for storing information from sensors of a corresponding priority level (e.g., the processor circuit includes respective queues for storing information from the impact sensor, pressure sensors and receptacle sensors). The retrieved information is stored in an appropriate queue associated with the particular sensor having available information. Processor circuit 82 processes and formats the stored information for transmission over the telemetry link to receiving station 80 (FIG. 1) via transmitter 90. The processor circuit basically retrieves sensor information from the appropriate queue in accordance with the prioritization and produces reports for the channels of the grid and damage circuits providing the retrieved information. The reports are subsequently transmitted to the receiving station for assessment of the impact as described below.

Figure 4:
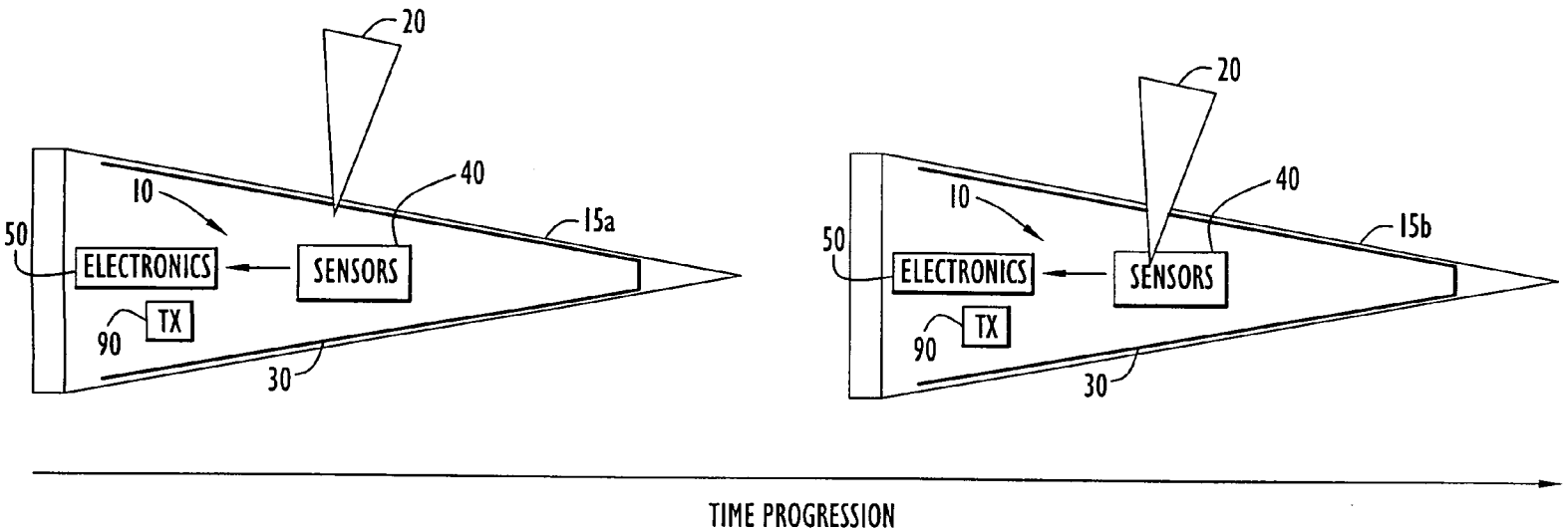
FIG. 4 is a diagrammatic illustration of an intercept object penetrating the exemplary target object employing the impact detection system of the present invention.

Typically, the desired information from an impact on the target includes the impact location and the damage sustained. For example, a ballistic missile target may sustain damage from an intercept object upon initial impact, while the target object payload may sustain damage from further penetration of the intercept object into the target object. By way of example and with reference to FIG. 4, an intercept object 20 may initially impact the exterior surface of target object 15 (e.g., the surface impact is illustrated by target object 15*a* in FIG. 4). The target object is substantially similar to the target object described above and includes impact detection system 10. Optical fibers of impact sensor 30 are severed by the surface impact, thereby enabling grid circuits 84 (FIG. 3) to provide information to processor circuit 82. As the intercept object penetrates the target object (e.g., the penetration is illustrated by target object 15*b* in FIG. 4), the pressure and/or receptacle sensors 60, 70 detect damage or other conditions within the object due to the impact, thereby enabling corresponding damage sensor circuits 86, 88 to provide information to processor circuit 82.

As the target object is decomposing from the impact, plural sensors are reporting information to the processor circuit at approximately the same time. Since the electronics package collects sensor information at a higher rate than the transmission rate of the telemetry link, the telemetry link may become a bottleneck for transmission of the sensor information to the receiving station. The bottleneck causes internal damage sensor information to compete with optical fiber grid information for telemetry bandwidth during an impact. This may enable valuable information pertaining to the target impact to be lost due to lack of transmission of that information within the limited time interval available prior to target destruction or impact detection system disablement.

However, the present invention provides intelligent integration of sensor information from plural types of sensors (e.g., optical fiber sensors, pressure sensors, GPS time, receptacle sensors, etc.) into a limited bandwidth and short reporting time telemetry signal. The present invention selects the important information during impact via a dynamic prioritization scheme. Basically, telemetry priority is provided to the grid sensors over the internal damage sensors (e.g., pressure sensors 60 and receptacle sensors 70) until sufficient grid information has been received by the receiving station to precisely determine the impact location. Once sufficient grid information has been transmitted, telemetry bandwidth priority is provided to the internal damage sensors. The present invention mitigates the risk of losing important location and damage sensor information. The prioritization scheme of the present invention is performed by processor circuit 82 and may be modified to accommodate different application profiles to balance prioritization (e.g., between location indicators and damage sensors, different target sizes and impact velocities, etc.).

Figure 5:
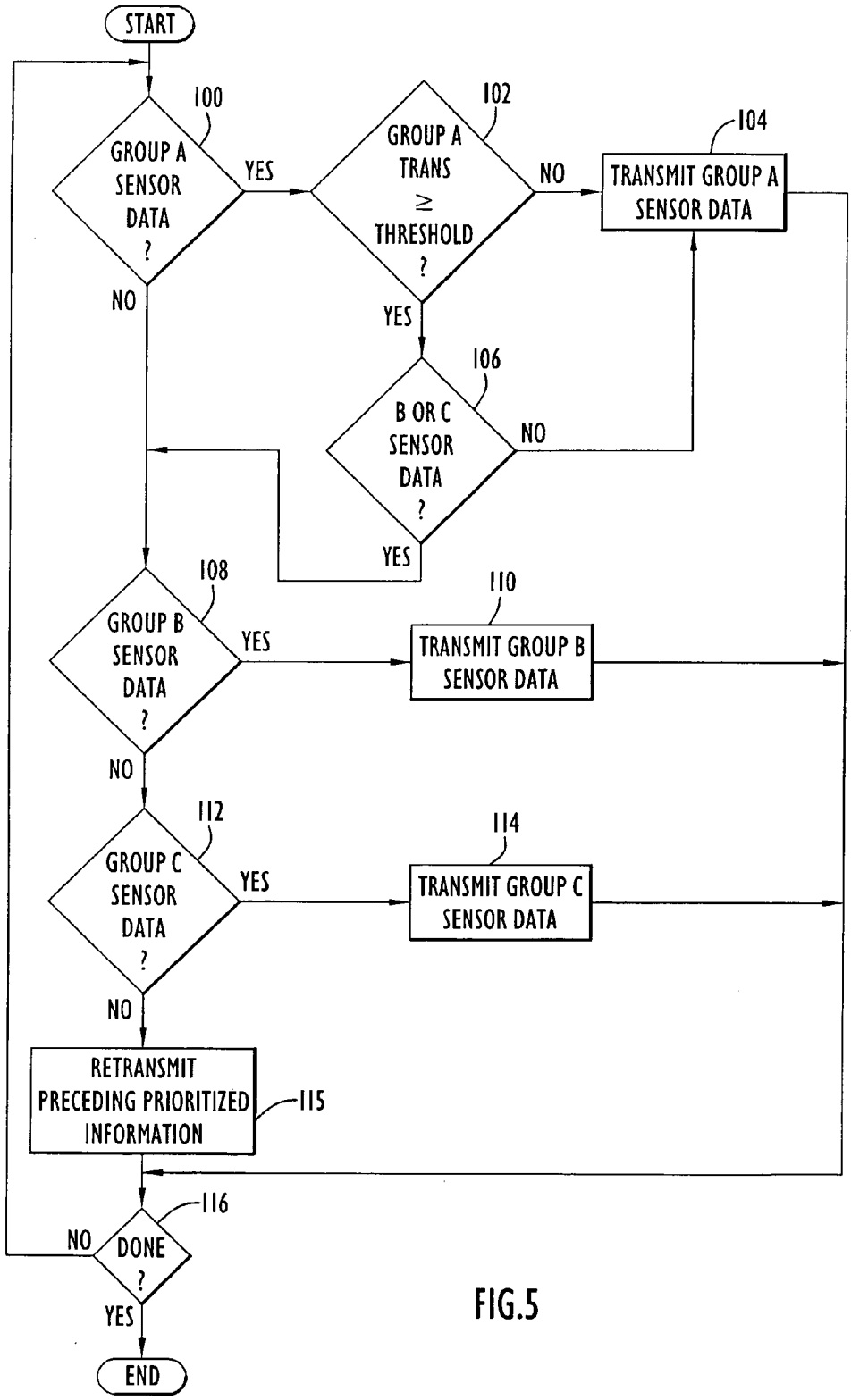
FIG. 5 is a procedural flow chart illustrating the manner in which sensor information is prioritized and allocated telemetry bandwidth according to the present invention.

The manner in which processor circuit 82 allocates telemetry bandwidth to sensor information is illustrated in FIGS. 1 and 5. Initially, the various sensor types are classified into a plurality of priority categories. By way of example only, impact sensor 30 providing location information is classified as Group A sensors including the greatest priority, pressure sensors 60 are classified as Group B sensors including priority subordinate to Group A, and receptacle sensors 70 are classified as Group C sensors including priority subordinate to Groups A and B.

The prioritization scheme of the present invention favors reporting impact sensor information (e.g., Group A sensors) until sufficient location information has been transmitted to receiving station 80 to accurately determine the impact location. The quantity of impact sensor information (e.g., quantity of channel reports transmitted) for accurate determination of the impact location is indicated by a threshold (e.g., the parameter Alimit indicated in Table I below). The threshold may be modified depending on the details of an application profile. Once enough impact sensor information (e.g., from Group A sensors) has been transmitted, the prioritization scheme favors reporting information from the pressure sensors (e.g., Group B sensors) and receptacle sensors (e.g., Group C sensors), with a preference for reporting the pressure sensor information over the receptacle sensor information. The scheme for prioritizing Group A, B and C sensor information is indicated in Table I below.

TABLE I

| Different States or Conditions | Number of Group A Sensor Channels Transmitted | Number of Group A Sensor Channels Ready to Transmit | Number of Group B Sensor Channels Ready to Transmit | Number of Group C Sensor Channels Ready to Transmit | Action |
|---|---|---|---|---|---|
| 1 | Any | None | None | None | Idle |
| 2 | Any | None | >0 | Any | Transmit B |
| 3 | Any | None | None | >0 | Transmit C |
| 4 | <Alimit | >0 | Any | Any | Transmit A |
| 5 | =>Alimit | Any | >0 | Any | Transmit B |
| 6 | =>Alimit | Any | None | >0 | Transmit C |
| 7 | =>Alimit | >0 | None | None | Transmit A |

The various sensors may be classified into any quantity of groups, where the groups (and, hence, the sensors) may be prioritized in any suitable fashion for an application.

An intercept object initially impacts the exterior surface of target object 15 as described above. Optical fibers of impact sensor 30 are severed by the surface impact, thereby enabling grid circuits 84 (FIG. 3) to provide information to processor circuit 82. As the intercept object penetrates the target object, the pressure and/or receptacle sensors 60, 70 detect damage or other conditions within the object due to the impact, thereby enabling corresponding damage sensor circuits 86, 88 to provide information to processor circuit 82 as described above. The processor circuit prioritizes the sensor information for transmission to receiving station 80. In particular, the processor circuit determines the availability of Group A or impact sensor information. This may be accomplished by determining the presence of impact sensor information within the associated queue as described above. If impact sensor information is available as determined at step 100, the processor circuit determines the quantity of impact sensor channel reports or information previously transmitted to the receiving station. When the quantity of transmitted impact sensor information is below a threshold (e.g., indicating an insufficient quantity of impact sensor information has been transmitted to the receiving station to identify an impact location) as determined at step 102, the impact sensor information is allocated telemetry bandwidth, retrieved from the associated queue for processing and transmitted over the telemetry link to receiving station 80 via transmitter 90 at step 104 (e.g., corresponding to State 4 in Table I above). The quantity of transmitted impact or Group A sensor information is subsequently updated and may be maintained and updated by any conventional or other techniques (e.g., counters, etc.).

When the quantity of impact sensor information transmitted is equal to or exceeds the threshold (e.g., indicating a sufficient quantity of impact sensor information has been transmitted to the receiving station to identify an impact location) as determined at step 102, the processor circuit determines the availability of sensor information from the pressure (e.g., Group B) or receptacle (e.g., Group C) sensors. If sensor information is not available from either of these groups of sensors as determined at step 106, the available impact sensor information is allocated telemetry bandwidth, retrieved from the associated queue for processing and transmitted over the telemetry link to receiving station 80 via transmitter 90 at step 104 as described above (e.g., corresponding to State 7 in Table I above). Further, the quantity of transmitted impact or Group A sensor information is subsequently updated as described above.

When impact or Group A sensor information is unavailable as determined at step 100, or the impact or Group A sensor information is available, but a sufficient quantity of that information has been transmitted and pressure (e.g., Group B) or receptacle (e.g., Group C) sensor information is available as determined at step 106, the processor circuit determines the availability of Group B or pressure sensor information. This may be accomplished by determining the presence of pressure sensor information within the associated queue as described above. If pressure sensor information is available as determined at step 108, the pressure sensor information is allocated telemetry bandwidth, retrieved from the associated queue for processing and transmitted over the telemetry link to receiving station 80 via transmitter 90 at step 110 (e.g., corresponding to States 2 or 5 in Table I above).

If pressure or Group B sensor information is unavailable as determined at step 108, the processor circuit determines the availability of Group C or receptacle sensor information. This may be accomplished by determining the presence of receptacle sensor information within the associated queue as described above. If receptacle sensor information is available as determined at step 112, the receptacle sensor information is allocated telemetry bandwidth, retrieved form the associated queue for processing and transmitted over the telemetry link to receiving station 80 via transmitter 90 at step 114 (e.g., corresponding to States 3 or 6 in Table I above).

When sensor information is unavailable from each of the sensor groups (e.g., Groups A, B and C) as determined at steps 100, 108 and 112, the processor circuit is idle with respect to transmission of new information (e.g., corresponding to State 1 in Table I above) and retransmits the preceding prioritized information at step 115. The prioritization process is repeated as described above until a terminating condition (e.g., power down, etc.) has occurred as determined at step 116. The prioritization scheme of the present invention enables use of limited telemetry bandwidth with enhanced efficiency to transmit the most important impact information prior to target object destruction or impact detection system disablement. Receiving station 80 receives the sensor information (e.g., channel reports) and determines impact location and damage assessment based on that information (e.g., impact location, lethality of impact, damage sustained, etc.).

It will be appreciated that the embodiments described above and illustrated in the drawings represent only a few of the many ways of implementing a method and apparatus for impact detection and prioritization of impact information transmitted to a receiving station.

The present invention impact detection system may be disposed within or external of any desired airborne or ground-based target object (e.g., missile target, vehicle, stationary target, etc.). The target object may be of any shape or size and may be constructed of any suitable materials. The sensors of the impact detection system may be disposed in or on the target object at any locations and in any suitable arrangements. The impact detection system may detect impacts and other conditions on any quantity of target objects.

The impact sensor may be implemented by any conventional or other sensor detecting the location of an impact. The impact sensor may be of any quantity, shape or size and include any quantity of carriers arranged in any fashion. The carriers may carry any type of signal (e.g., electrical, optical, etc.), where the absence or presence of the signal on the carrier may indicate an impact. The fibers may carry any suitable optical signal (e.g., laser, light, LED, etc.) of any desired frequency or modulation. The grid fibers may be of any quantity, shape or size, may be constructed of any suitable materials and may be arranged in any fashion (e.g., at any desired orientations or angles, intersect in any fashion, etc.). The connectors may be implemented by any quantity of any conventional or other connectors to connect the grid to various components (e.g., light source, detectors, etc.). The grid may be of any quantity and may be disposed in or on any portion of the target object at any suitable locations to detect impacts.

The impact detection system may include any quantity of any types of conventional or other sensors to measure damage or other conditions (e.g., pressure sensors, mechanical damage sensors, broken wire sensors, GPS time, temperature sensors, rupture detectors, etc.). The pressure sensors may be implemented by any quantity of conventional or other pressure transducers or sensors. The receptacle sensor may be of any quantity and include any quantity of carriers arranged in any fashion. The carriers may carry any type of signal (e.g., electrical, optical, etc.), where the presence or absence of the signal on the carrier may indicate a ruptured receptacle. The receptacle and pressure sensors may be disposed in or on the receptacles or other objects in any suitable fashion.

The electronics package components (e.g., sensor circuits, power circuits, processor circuit, etc.) may be implemented by any quantity of any conventional or other hardware modules (e.g., processor, integrated circuit, logic, programmable gate array, etc.) and/or software modules performing the functions described herein. The components may be arranged in any suitable fashion. The grid circuits may be implemented by any conventional or other circuitry and may include any quantity of channels to accommodate any quantity of grid fibers. The pressure circuits may be implemented by any conventional or other circuitry and may include any quantity of channels to accommodate any quantity of pressure sensors. The receptacle circuits may be implemented by any conventional or other circuitry and may include any quantity of channels to accommodate any quantity of receptacle sensors. The sensor circuits (e.g., grid, pressure, receptacle, etc.) may utilize any conventional or other techniques to condition and convert the sensor signals to digital signals for processing. Alternatively, analog signals may be processed for transmission to the receiving station (e.g., the receiving station may process the analog signals or convert the analog signals to digital signals).

The power circuit may be may be implemented by any conventional or other circuitry to distribute power signals of any desired level (e.g., any voltage or current) or type (e.g., AC, DC, etc.) to any electronic package components. The power and data busses may be implemented by any conventional or other devices transporting power and/or data signals (e.g., busses, conductors, etc.). The laser source may be implemented by any conventional or other optical signal source (e.g., laser, light source, LED, etc.) providing an optical signal at any desired frequency and/or modulation. The detector units may be implemented by any quantity of any conventional or other detection devices (e.g., photo-detectors, voltage or current meters, etc.) detecting any suitable energy form (e.g., laser, light, electrical signals, etc.). The detector units and sensors may be coupled to the sensor circuits via any conventional or other techniques (e.g., connectors, etc.).

The transmitter may be implemented by any conventional or other transmitter and may transmit signals in any desired energy form and at any desired frequency or modulation. The communication link between the transmitter and receiving station may be implemented by any suitable communications medium (e.g., wireless link, optical signals, radio frequency signals, etc.), may utilize any communications protocol and may include any suitable bandwidth. The receiving station may be implemented by any conventional or other receiving unit and may include any conventional or other components (e.g., processor, application specific equipment, communications equipment (e.g., receiver, antenna, etc.)) to receive (and/or transmit) and process information.

The processor circuit may be implemented by any conventional or other hardware modules (e.g., circuitry, programmable gate array, logic, integrated circuit, microprocessor, etc.) and/or software modules. The processor circuit may include any quantity of queues or other storage devices (e.g., stacks, arrays, memory devices, etc.) to store sensor data in any fashion. The processor circuit may format the information in any desired fashion for transmission to the receiving station. The transmissions to the receiving station (e.g., channel reports or sensor information, etc.) may include any desired information or format. The processor circuit may retrieve sensor information upon being informed of availability and store the information in associated memory devices.

Alternatively, the processor circuit may retrieve sensor information after prioritization and prior to transmission to a receiving station. The sensor circuits may provide any suitable indication or flag to indicate availability of sensor information. The flag or indication may include any desired information (e.g., quantity of measurements or sensor channels, etc.). The processor circuit may alternatively periodically poll the sensor circuits to determine availability of and/or retrieve sensor information.

The sensors of the same or different types may be prioritized in any desired fashion based on any criteria. For example, different portions of the impact sensor or damage sensors may be assigned different priorities to enable certain impact locations or damage to have priority for transmission. The priority may be assigned manually prior to operation or dynamically based on any desired parameters or criteria. The system may employ any quantity of priority levels and assign any quantity of any types of sensors to those levels in any desired fashion. The threshold may be set to any desired value providing transmission of sufficient information, and may be of any quantity and applied to any of the priority levels to control transmission of information. The thresholds may be set to the same or different values for the priority levels. Further, the priority levels may be associated with any desired conditions prior to transmission of sensor information at those levels (e.g., priority may be based on satisfaction of any desired conditions, such as a quantity of transmissions of information from specific priority levels or from any quantity of previous or subsequent levels, etc.). The various functions of the electronics package may be distributed in any manner among the electronics package components and/or among any quantity of hardware and/or software modules. The algorithms described above and illustrated in the flow chart and diagrams may be modified in any manner that accomplishes the functions described herein.

The present invention is not limited to the applications described above, but may utilized for various applications to detect conditions. For example, the present invention may be utilized to provide lethality data for ballistic missile targets. Further, the present invention may serve on the space shuttle or other flight vehicle to detect the loss of tiles or other vehicle components. By way of example, the fiber optic sensor array may be disposed on the shuttle or vehicle to provide continuous monitoring of critical areas for loss of tiles or impacts with debris that may cause damage. Moreover, the present invention may be utilized on a space station or other structure to monitor and record impacts with space debris or other objects that may potentially result in damage to the structure.

In addition, the present invention may be utilized for various security or monitoring purposes. For example, the present invention may be disposed on commercial shipping or other containers to determine occurrence of tampering or damage, especially during transit.

It is to be understood that the terms "top", "bottom", "front", "rear", "side", "height", "length", "width", "upper", "lower", "right", "left" and the like are used herein merely to describe points of reference and do not limit the present invention to any particular orientation or configuration. Further, the various symbols utilized herein for sensor groups (e.g., Group A, Group B, Group C, etc.) are for descriptive purposes and any suitable symbols or characters may be employed to indicate priority levels. Moreover, the timestamp may be generated by internal devices (e.g., clock, etc.) or external devices (e.g., GPS time). In addition, the receiving station may process the sensor information via any conventional or other techniques to assess impact location, damage or other conditions.

From the foregoing description, it will be appreciated that the invention makes available a novel method and apparatus for impact detection and prioritization of impact information transmitted to a receiving station, wherein impacts and subsequent effects on a target object are detected by various sensors with impact information being transmitted to a receiving station in accordance with a priority scheme allocating the limited telemetry bandwidth available for the transmission.

Having described preferred embodiments of a new and improved method and apparatus for impact detection and prioritization of impact information transmitted to a receiving station, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A sensing system to collect information pertaining to an impact on an object, wherein said collected information is transferred from said sensing system over a communication link with limited capacity, said system comprising:

a plurality of sensors to collect information associated with an impact on an object, wherein said plurality of sensors includes an impact sensor to detect one or more locations on said object receiving said impact and at least one damage sensor to measure information pertaining to damage sustained by said object from said impact, and wherein each sensor is assigned a corresponding priority level for transference of information collected by that sensor from said sensing system over a common communication link with limited capacity; and a processing unit to receive and process collected information from said sensors and to allocate said limited capacity of said communication link to said received information in accordance with said priority level of an associated sensor providing said information to transfer said collected information from said sensing system over said communication link, wherein said processing unit allocates said limited capacity of said communication link to collected information available from said impact sensor prior to allocation of that capacity to collected information available from said at least one damage sensor until a quantity of impact sensor information is transferred sufficient to identify an impact location.

2. The system of claim 1, wherein said impact sensor includes a plurality of signal carriers arranged in an intersecting fashion to form a grid with each carrier intersection defining an area, and wherein disablement of particular intersecting carriers from an impact identifies said corresponding area to indicate a location of said impact.

3. The system of claim 2, wherein said signal carriers include optical fibers.

4. The system of claim 1, wherein said at least one damage sensor includes a pressure sensor to measure a pressure within said object.

5. The system of claim 1, wherein said at least one damage sensor includes a receptacle sensor to detect rupture of at least one receptacle disposed within said object.

6. The system of claim 1, wherein said impact sensor is assigned a priority level with a greater priority than said at least one damage sensor.

7. The system of claim 6, wherein said processing unit allocates communication link capacity to collected information from said impact sensor in response to said impact sensor information being available and information from said at least one damage sensor being unavailable.

8. The system of claim 6, wherein said at least one damage sensor includes a plurality of damage sensors with each damage sensor assigned a corresponding priority level, and wherein said processing unit allocates communication link capacity to information available from the damage sensor with a greatest priority level in response to at least one of said impact sensor information being unavailable and said quantity of said impact sensor information being transmitted is sufficient to identify said impact location.

9. The system of claim 1, wherein said object includes a target and said system further includes:

a transmitter to transmit said information allocated to said communication link capacity over said communication link; and a receiving station to process said transmitted information to determine at least one of a target impact location and target damage.

10. A method of collecting information pertaining to an impact on an object, wherein said collected information is transferred from said object over a communication link with limited capacity, said method comprising:

(a) collecting information associated with an impact on an object via a plurality of sensors, wherein said plurality of sensors includes an impact sensor to detect one or more locations on said object receiving said impact and at least one damage sensor to measure information pertaining to damage sustained by said object from said impact, and wherein each sensor is assigned a corresponding priority level for transference of information collected by that sensor from said object over a common communication link with limited capacity; and (b) processing collected information from said sensors via a processing unit and allocating communication link capacity to said collected information in accordance with said priority level of an associated sensor providing said information to transfer said collected information from said object over said communication link, wherein said limited capacity of said communication link is allocated to collected information available from said impact sensor prior to allocation of that capacity to collected information available from said at least one damage sensor until a quantity of impact sensor information is transferred sufficient to identify an impact location.

11. The method of claim 10, wherein said impact sensor includes a plurality of signal carriers arranged in an intersecting fashion to form a grid with each carrier intersection defining an area, and step (a) further includes:

(a.1) detecting disablement of particular intersecting carriers from an impact to identify said corresponding area to indicate a location of said impact.

12. The method of claim 10, wherein said at least one damage sensor includes a pressure sensor, and step (a) further includes:

(a.1) measuring a pressure within said object via said pressure sensor.

13. The method of claim 10, wherein said at least one damage sensor includes a receptacle sensor, and step (a) further includes:

(a.1) detecting a rupture of at least one receptacle disposed within said object via said receptacle sensor.

14. The method of claim 10, wherein said impact sensor is assigned a priority level with a greater priority than said at least one damage sensor.

15. The method of claim 14, wherein step (b) further includes:

(b.1) allocating communication link capacity to collected information from said impact sensor in response to said impact sensor information being available and information from said at least one damage sensor being unavailable.

16. The method of claim 14, wherein said at least one damage sensor includes a plurality of damage sensors with each damage sensor assigned a corresponding priority level, and step (b) further includes:

(b.1) allocating communication link capacity to information available from the damage sensor with a greatest priority level in response to at least one of said impact sensor information being unavailable and said quantity of said impact sensor information being transmitted is sufficient to identify said impact location.

17. The method of claim 10, wherein said object includes a target and said method further includes:

(c) transmitting said information allocated to said communication link capacity over said communication link from said target to a receiving station; and (d) processing said transmitted information at said receiving station to determine at least one of a target impact location and target damage.

* * * * *